US006948268B1

(12) United States Patent
Ronca

(10) Patent No.: US 6,948,268 B1
(45) Date of Patent: Sep. 27, 2005

(54) ARTICULATED SHOVEL

(76) Inventor: Michele Ronca, 9731 Oakhill Dr. S.W., Calgary, Alberta (CA) T2V 3W7

( * ) Notice: Subject to any disclaimer, the term of this patent is extended or adjusted under 35 U.S.C. 154(b) by 0 days.

(21) Appl. No.: 10/867,368

(22) Filed: Jun. 14, 2004

(51) Int. Cl.[7] ..... E01H 5/02
(52) U.S. Cl. ..... 37/284; 294/54.5
(58) Field of Search ..... 37/265, 283–285; 294/54.5, 51, 53.5, 57

(56) References Cited

U.S. PATENT DOCUMENTS 3,469,326 A * 9/1969 Malickson ..... 37/265
4,512,091 A * 4/1985 Leininger et al. ..... 37/278
5,048,206 A * 9/1991 Jones ..... 37/265
5,581,915 A * 12/1996 Lobato ..... 37/285
6,219,944 B1 * 4/2001 Byers ..... 37/265
6,457,757 B2 * 10/2002 Hendrick ..... 294/54.5
6,675,507 B2 * 1/2004 Petruzzelli ..... 37/284

* cited by examiner

*Primary Examiner*—Robert E Pezzuto

(57) ABSTRACT

In accordance with the present invention, an articulated, self-supporting shovel is provided for removing material, such as snow from a surface such as a walkway or driveway. The articulated shovel comprises two main components, a wheeled, lateral body frame and a wheeled shovel carriage that is pivotally connected to the body frame and which is angularly adjustable with respect to the body frame. An adjustment arm is provided which is attached to the shovel carriage and which is received by one of a plurality of notches formed into an adjustment rack, which is mounted to the body frame. Through manipulation of the adjustment arm, the shovel carriage is pivoted through a predefined arc and retained at a desired position therealong by inserting the adjustment arm into a corresponding notch. Additionally, a push handle is attached to the body frame and extends therefrom for a user to grasp and to push the shovel.

19 Claims, 3 Drawing Sheets

ARTICULATED SHOVEL

FIELD AND BACKGROUND OF THE INVENTION

The present invention relates generally to shovels. More particularly, relating to a new and useful articulated shovel for removing material, such as snow from a surface.

Shovels are well known tools in the art for lifting, pushing or otherwise moving a material from one location to a second location. There are two main classifications of shovels regardless of the handle structure or blade structure the first class of shovels are used to lift and transport a material and the second class of shovels are used to push material like a plow. The articulated shovel of the present invention is of the second class.

It is also generally well known that some types of snow can be particularly heavy, such as wet, slushy snow or icy snow. Attempting to shovel a walkway or driveway covered with wet snow can be difficult for many people because of the weight.

There have been many attempts in the prior art to provide a user with a plow or push shovel that is easy to operate and removes the burden of the weight of the snow from the user. How heretofore, the prior art has be deficient in providing an articulated, self-supporting push shovel for removing snow from a path that is easy to operate, does not require special tools or great dexterity to adjust, and does not require the user to bear partial weight of the shovel.

As such the present invention provides an articulated shovel that overcomes the deficiencies present in the art of plow type shovels.

SUMMARY OF THE INVENTION

In accordance with the present invention, an articulated shovel is provided for removing material, such as snow from a surface such as a walkway or driveway.

The articulated shovel comprises two main components, a wheeled, lateral body frame and a wheeled shovel carriage that is pivotally connected to the body frame and which is angularly adjustable with respect to the body frame. The lateral body frame includes a pair of ends to which a pair of wheels, one each is rotatably attached to each end of the body frame. A push arm extends from and forward of the body frame to which the wheeled shovel carriage is pivotally connected to. The shovel carriage carries a shovel blade and includes a set of wheels, such as caster wheels, that are mounted to and along a lower portion of the carriage to provide rolling support thereto and to raise a bottom lip of the shovel blade slightly above the ground surface to prevent the lip from impacting raised surfaces, such as rocks or edges of uneven walkways.

An adjustment arm attached to the shovel carriage extends rearward therefrom towards the body frame and which is received by one of a plurality of notches formed into an adjustment rack, which is mounted to the body frame. Through manipulation of the adjustment arm, the shovel carriage is pivoted through a predefined arc and retained at a desired position therealong by inserting the adjustment arm into a corresponding notch. Additionally, a push handle is attached to the body frame and extends therefrom for a user to grasp and push the articulated shovel across a surface to remove material, such as snow therefrom.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
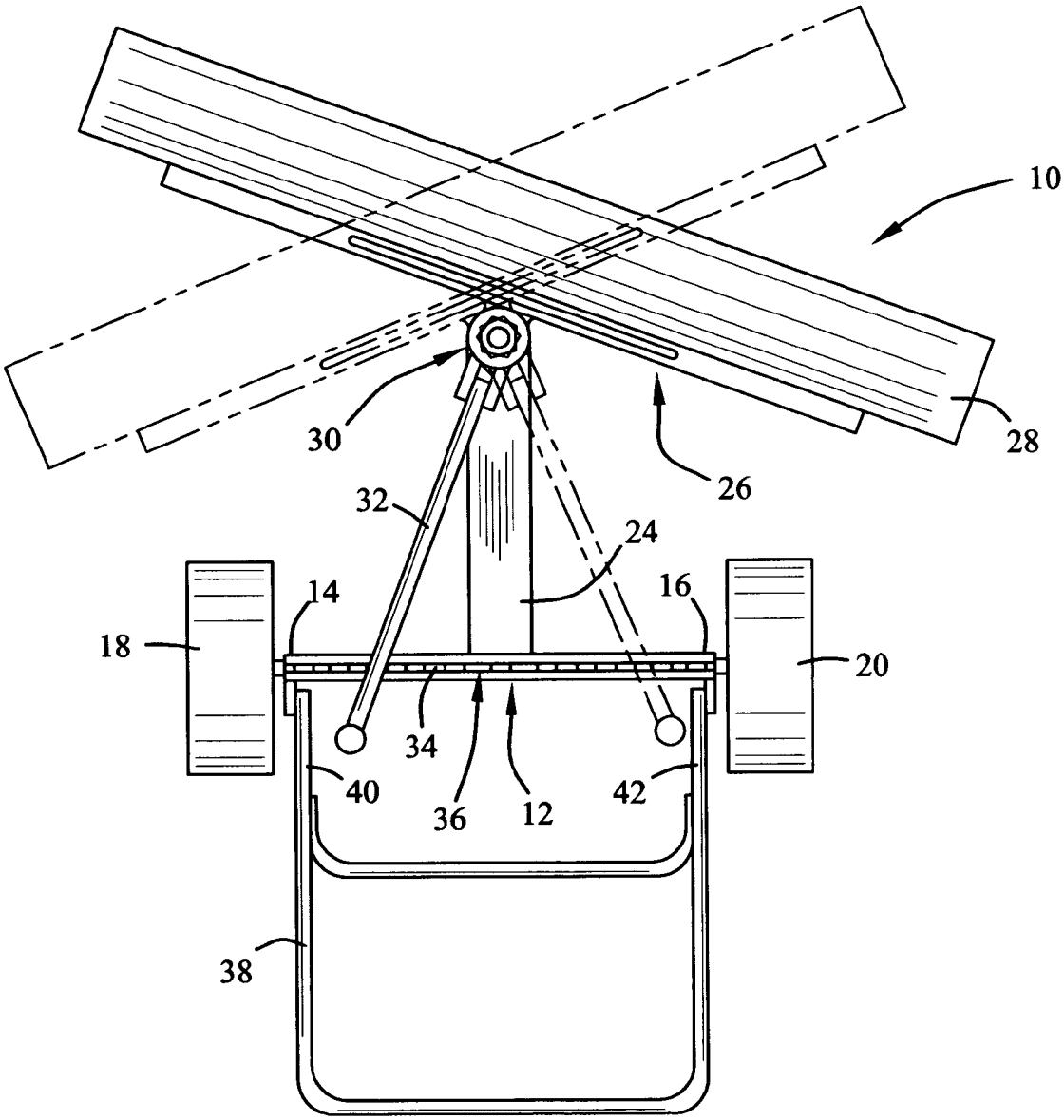
FIG. 1 is a top plan view of a preferred embodiment of the articulated shovel constructed in accordance with the principles of the present invention.

Referring now to the drawings, and particularly to FIGS. 1–4, a preferred embodiment of the articulated shovel of the present invention is shown and generally designated by the reference numeral 10.

In FIG. 1, a new and improved embodiment of the articulated shovel 10 of the present invention for removing a material from a surface is illustrated and will be described. More particularly, the articulated shovel 10 includes a lateral body frame 12 having a pair of ends 14 and 16 to which a pair of wheels 18 and 20 are rotatably attached. Preferably, each wheel 18 and 20 are connected to a common axle 22, which extends through an axle tube positioned within the body frame 12. Most preferably, the wheels 18 and 20 include a hub 21 and rubber tires 23 having a tread pattern.

A push arm 24 extends from and forward of the body frame 12. In the current embodiment, the push arm 24 is rigid with the body frame 12 and extends normal therefrom. However, it is contemplated that the push arm 24 may be pivotally attached to the body frame 12 to be angularly adjustable with respect thereto. In addition, a locking means (not illustrated) would be provided for locking the angular position of the push arm 24 with respect to the body frame 12. Such locking means may include a plurality of cooperating through holes formed through the body frame 12 around the pivot connection of the push arm 24 with the body frame and a through hole formed through the push arm. A pin can be inserted through the hole in the push arm 24 and through any one of the holes formed through the body frame 12 to lock the push arm therewith.

A shovel carriage 26 carrying a shovel blade 28 is positioned forward of the push arm 24 and is pivotally connected thereto by a pivot assembly 30. The shovel carriage 26, pivotally attached to the push arm 24 is angularly adjustable through a predefined arc with respect to the body frame 12 and the push arm. The shovel carriage 26 is pivotal to either the right or left side of the push arm 24 to form an acute angle therewith, as illustrated. Preferably, the acute angle is between 35 and 90 degrees. Additionally, the shovel carriage may be positioned so that is normal to the push arm 24 and parallel to the body frame.

An adjustment arm 32 extends from the shovel carriage towards the body frame 12 and is received by one of a plurality of notches 34 formed into an adjustment rack 36 attached to the body frame. Moving the adjustment arm 32 along the adjustment rack 36 and inserting the arm into one of the notches 34 adjusts the angular position of the shovel carriage 26. To adjust the shovel carriage 26 so that it forms an acute angle with the right side of the push arm 24, the adjustment arm 32 is positioned to the left side of the adjustment rack 36. To adjust the shovel carriage 26 so that it forms an acute angle with the left side of the push arm 24, the adjustment arm 32 is positioned to the right side of the adjustment rack 36.

The adjustment arm 32 can be of a resilient material, which deflects upon a user lifting the arm from one notch to place it into a second notch. Or preferably, the adjustment arm 32 is pivotally attached to the shovel carriage 26 at pivot connection 34 so that the adjustment arm can be pivoted through a plan normal to the shovel carriage allowing the free end of the arm to be easily raised from one notch and placed into a second notch. A biasing means may be provided to urge the arm in a downward direction to retain the arm within a notch. One example of a biasing means is a leaf spring wound around the pivot connection between the adjustment arm 32 and the shovel carriage 26. One of ordinary skill in the art would readily appreciate the possible use of many different biasing means and the incorporation thereof with the pivot connection 34 and the adjustment arm 32.

A push handle 38 is attached to the body frame 12 and extends therefrom for a user to grasp and push the articulated shovel 10 across a surface to remove a material therefrom. In this embodiment, the handle 38 is a U-shaped handle having a pair of legs 40 and 42 each attached to the body frame 12 towards the ends 14 and 16 thereof. Preferably, the legs 40 and 42 are pivotally attached to the body frame 12 so that height of handle 36 can be adjusted with respect thereto. Most preferably, the handle 38 is detachable from the body frame 12 to reduce the amount of space required for storing the articulate shovel 10.

Figure 3:
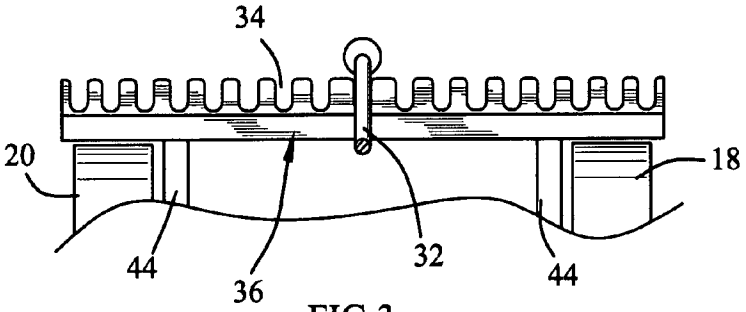
FIG. 3 is an enlarged, partial cross section view taken along line 3—3 in FIG. 2.
Figure 2:
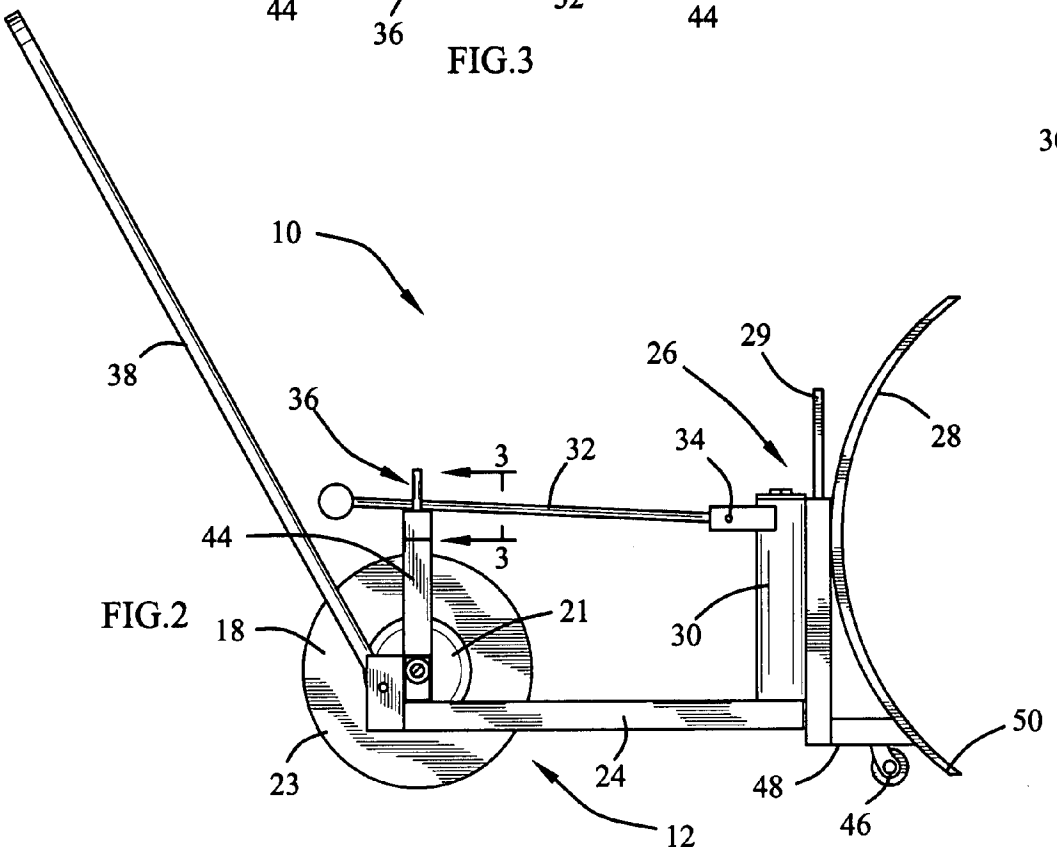
FIG. 2 is a side elevation view of the articulated shovel of FIG. 1 with one wheel removed from the body frame so as clearly illustrate the body frame.

Referring now to FIGS. 2 and 3, which illustrates a side elevation view of the articulated shovel 10 with the right wheel 20 removed to more clearly illustrate the body frame 12. In this view, a preferred placement of the adjustment rack 36 is illustrated, wherein the adjustment rack is attached the body frame 12 at a spaced distance therefrom at a height above the wheels 18 and 20 by a pair of uprights 44 (only one is viewable). The raised height of adjustment rack 36 prevents a user from having bend over a considerable distance to adjust the angular position of the shovel carriage 26. While the rack 36 is illustrated to be only slightly elevated above the wheels 18 and 20, this should not limit the height at which the adjustment rack can be elevated above the body frame 12. Furthermore, the adjustment 36 rack can extend beyond the sides 14 and 16 of the body frame 12 and be elevated so that the bottom thereof is raised slightly above the wheels 18 and 20 to scrape off built up material, such as snow that may accumulate on the wheels. An added benefit of this configuration is a higher degree of adjustability of the shovel carriage 26 with the added length of the adjustment rack 36 a higher resolution can be implemented affording a user with more control over the exact angular position of the shovel carriage.

Additionally, a set of wheels 46 (only one of the pair is visible), such as caster wheels, are attached to a bottom portion 48 of the shovel carriage 26 at a spaced distance from one another to provide wheeled support to the shovel carriage. Preferably 3 wheels are provided in the set of wheels 46, one positioned towards either end of the shovel carriage 26 and the third positioned about a mid-point between the first and second. This wheel arrangement allows for the shovel carriage 26 to extend slightly over a ledge, such as a ledge that would be present on a raised walkway, while still being supported by at least 2 of the three wheels 46. Unlike prior art wheeled shovels that only provide wheels either at the shovel blade or at a spaced distance reward of the shovel blade, which requires the user to bear partial weight of the shovel, the preferred embodiment of the present invention is self-supporting so that the user's efforts are directed only towards pushing the shovel to remove material from a surface, the user is not required to bear partial weight of the shovel. Preferably, the caster wheels 46 are positioned so that the bottom lip 50 of the shovel blade 28 is slightly raised from the surface to prevent the lip from impacting raised surfaces, such as rocks or edges of uneven walkways, which could damage the shovel blade or injure a user.

A lift handle 29 is provide, which is attached to the shovel carriage 26 and provides a user with an easy means to grasp the shovel carriage for lifting the entire articulate shovel into a bed of a truck as an example, or to lift the shovel blade 28 above and over a raised surface which is higher then the lift provided the wheels 46. Preferably, the handle is U-shaped and each leg is fixedly attached to the shovel carriage.

Figure 4:
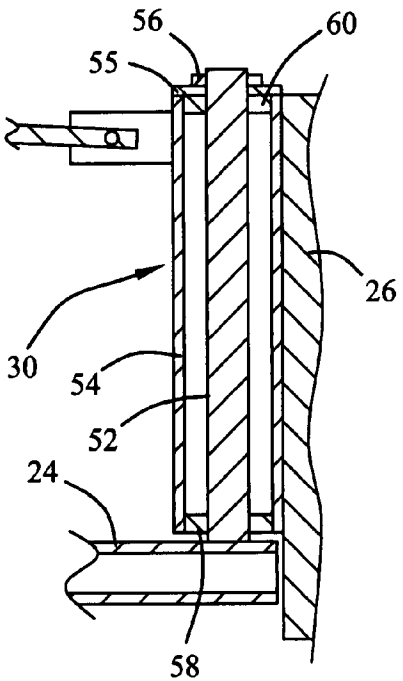
FIG. 4 is an enlarged, partial cross section view taken laterally through the pivot connection between the body frame and the shovel carriage.

Turning now to FIG. 4, which is an enlarged partial cross section view taken through the pivot assembly 28. The pivot assembly 28 comprises a shaft 52 extending upward from the push arm 24. The shaft 52 is pivotally received by a collar 54, which is fixedly attached to the shovel carriage 26. The shaft 52 extends slightly above the collar 54 and receives a bearing plate 55 and a fastener 56, such as a nut or a cotter pin to prevent removal of the collar from the shaft. Preferably, bushings 58 and 60 are each inserted at opposite ends of the collar 54 and support the shaft 52 about the center of the collar.

Figure 5:
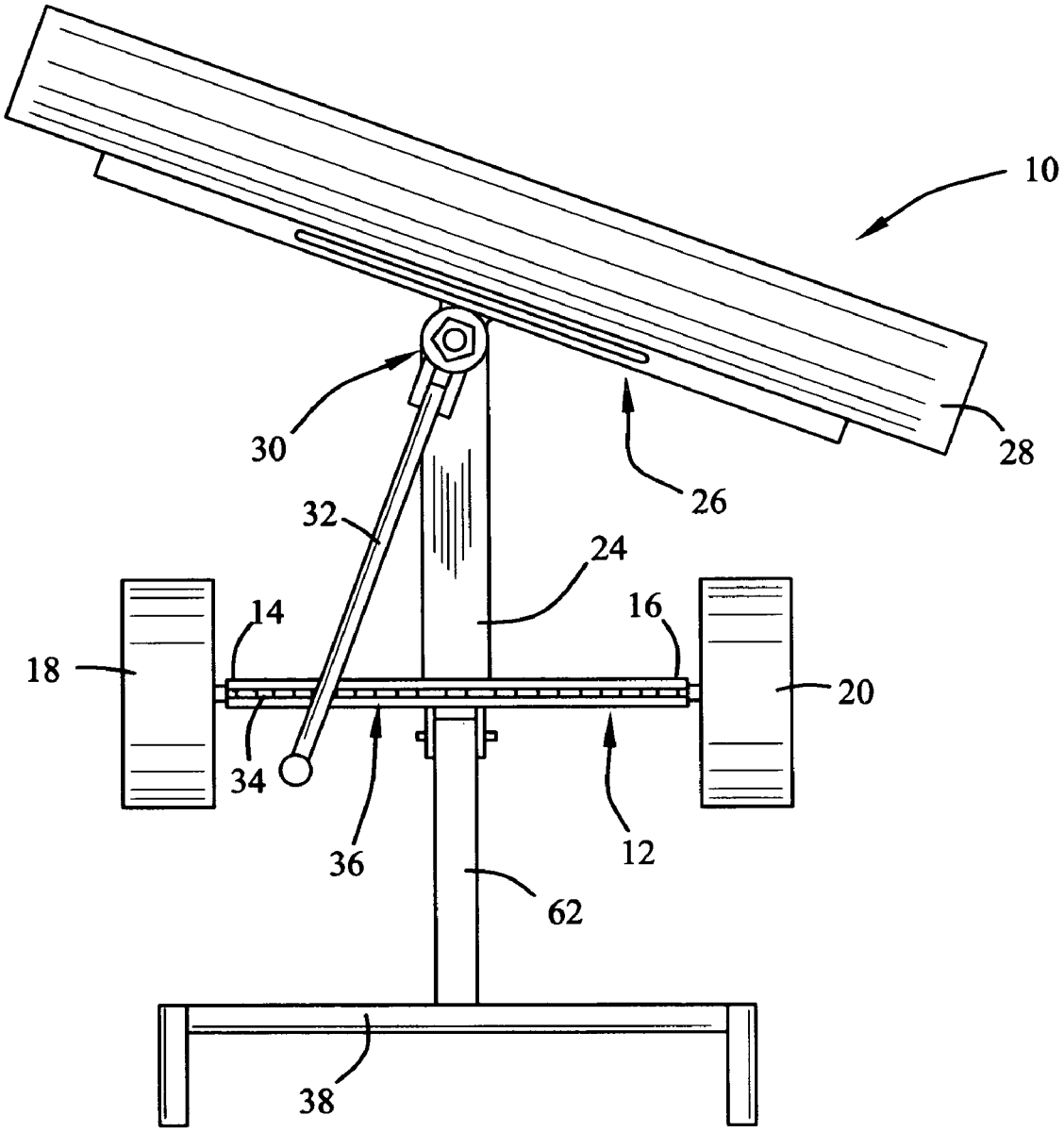
FIG. 5 is a top plan view of an alternate embodiment of the articulated shovel of the present invention.

Referring now to FIG. 5, an alternate embodiment of the articulated shovel of the present invention is illustrated. In this embodiment, the push handle 38 is a T-shaped handle having a single leg 62 attached to the body frame 12 approximate a mid-point thereof. Preferably, the leg 62 is pivotally attached to the body frame 12. Most preferably, the leg 62 is detachable from the body frame 12 for storing the articulate shovel.

A number of embodiments of the present invention have been described. Nevertheless, it will be understood that various modifications may be made without departing from the spirit and scope of the invention. Accordingly, other embodiments are within the scope of the following claims.

I claim:

1. An articulated shovel, comprising:

a lateral body frame having a pair of ends;

a shovel carriage;

a shovel blade mounted to said shovel carriage;

a set of wheels mounted to said shovel carriage providing wheeled support to thereto;

a push arm attached to and extending between said body frame and said shovel carriage, said shovel carriage pivotally attached to said push arm so that said shovel carriage can pivot with respect to said body frame;

a second pair of wheels rotatably attached to each end of said body frame;

an adjustment arm extending from said shovel carriage in a direction towards said body frame;

an adjustment rack attached to said body frame, said adjustment rack having a plurality of notches adapted to receive said adjustment arm so as to lock said shovel carriage at an angular position with respect to said body frame; and a push handle extending from said body frame, said push handle for grasping by a user to push said articulated shovel across a surface to remove a material therefrom.

2. The articulated shovel of claim 1, wherein said adjustment rack is attached latterly along said body frame.

3. The articulated shovel of claim 1, wherein said adjustment rack is attached to said body frame at an elevated distance therefrom.

4. The articulated shovel of claim 1, wherein said shovel carriage is pivotal to form an acute angle with respect to either a left or right side of said push arm.

5. The articulated shovel of claim 4, wherein said acute angle is between 35 and 90 degrees.

6. The articulated shovel of claim 1, further comprising:

a lift handle attached to said shovel carriage.

7. The articulated shovel of claim 1, wherein said shovel blade is attached to said shovel carriage forward thereof.

8. The articulated shovel of claim 1, wherein said push handle is a U-shaped handle having a pair of legs, one leg attached at each end of said body frame.

9. The articulated shovel of claim 1, wherein said push handle is a T-shaped handle having a single leg attached to said body frame about a midpoint thereof.

10. The articulated shovel of claim 1, wherein said adjustment rack extends beyond said pair of ends of said body frame and function as a scraper to remove accumulated material from said pair of wheels.

11. A self-supporting, articulated shovel, comprising:

a lateral body frame having a pair of ends;

a shovel carriage;

a shovel blade mounted to said shovel carriage;

a first set wheels mounted to said shovel carriage providing wheeled support to said shovel carriage;

a push arm attached to and extending between said body frame and said shovel carriage, said shovel carriage pivotally attached to said push arm so that said shovel carriage can pivot with respect to said body frame;

a second pair of wheels rotatably attached to each end of said body frame;

an adjustment arm extending from said shovel carriage in a direction towards said body frame;

an adjustment rack attached to said body frame, said adjustment rack having a plurality of notches adapted to receive said adjustment arm so as to lock said shovel carriage at an angular position with respect to said body frame, said adjustment rack is attached latterly along said body frame;

a push handle extending from said body frame, said push handle for grasping by a user to push said articulated shovel across a surface to remove a material therefrom; and said shovel carriage is pivotal to form an acute angle with respect to either a left or right side of said push arm.

12. The shovel of claim 11, wherein said adjustment rack is attached to a top surface of said body frame at a spaced distance therefrom by a pair of uprights.

13. The shovel of claim 12, wherein said push handle is pivotally attached to said body frame and said push handle is removably attached to said body frame for storage.

14. The shovel of claim 13, wherein said push handle is a U-shaped handle having a pair of legs, each leg attached to said body frame towards each end thereof.

15. The shovel of claim 13, wherein said push handle is a T-shaped handle having a single leg attached to said body frame about a midpoint thereof.

16. The shovel of claim 11, wherein said acute angle is between 35 and 90 degrees.

17. The shovel of claim 11, wherein said adjustment rack is attached to a top surface of said body frame at a spaced distance therefrom by a pair of uprights.

18. The shovel of claim 16, wherein said adjustment arm is pivotally attached to said shovel carriage so as to pivot in a plan normal to said carriage.

19. The shovel of claim 11, wherein said adjustment rack extends beyond said pair of ends of said body frame and function as a scraper to remove accumulated material from said pair of wheels rotatably attached to said ends of said body frame.

* * * * *